US011583923B2

(12) United States Patent
Sobu et al.

(10) Patent No.: US 11,583,923 B2
(45) Date of Patent: Feb. 21, 2023

(54) HYDROGENATION-DEHYDROGENATION METHOD FOR TIAL ALLOY AND METHOD FOR PRODUCING TIAL ALLOY POWDER

(71) Applicant: MITSUBISHI HEAVY INDUSTRIES AERO ENGINES, LTD., Aichi (JP)

(72) Inventors: Shintaro Sobu, Tokyo (JP); Tadayuki Hanada, Aichi (JP)

(73) Assignee: MITSUBISHI HEAVY INDUSTRIES AERO ENGINES, LTD., Aichi (JP)

( * ) Notice: Subject to any disclaimer, the term of this patent is extended or adjusted under 35 U.S.C. 154(b) by 728 days.

(21) Appl. No.: 16/319,643

(22) PCT Filed: Dec. 6, 2017

(86) PCT No.: PCT/JP2017/043858
§ 371 (c)(1),
(2) Date: Jan. 22, 2019

(87) PCT Pub. No.: WO2018/105664
PCT Pub. Date: Jun. 14, 2018

(65) Prior Publication Data

US 2021/0276094 A1 Sep. 9, 2021

(30) Foreign Application Priority Data

Dec. 7, 2016 (JP) ..... JP2016-237870

(51) Int. Cl.
*B22F 9/02* (2006.01)
*C22C 1/04* (2006.01)
(Continued)

(52) U.S. Cl.
CPC ..... *B22F 9/023* (2013.01); *C22C 1/0458* (2013.01); *C22C 14/00* (2013.01); *C22F 1/183* (2013.01); *B22F 2201/013* (2013.01)

(58) Field of Classification Search
CPC ..... B22F 9/023; B22F 2201/013; B22F 2998/10; B22F 9/04; C22C 1/0458;
(Continued)

(56) References Cited

U.S. PATENT DOCUMENTS

2013/0071284 A1 3/2013 Kano et al.
2014/0255240 A1 9/2014 Fang et al.
(Continued)

FOREIGN PATENT DOCUMENTS

CN 103639408 A 3/2014
JP 03122205 A 5/1991
(Continued)

OTHER PUBLICATIONS

Bandyopadhyay et al. The Ti—Al—C System, Journal of Phase Equilibria vol. 21 No. 2 (2000) (Year: 2000).*
(Continued)

*Primary Examiner* — Brian D Walck
*Assistant Examiner* — Danielle Carda
(74) *Attorney, Agent, or Firm* — Hauptman Ham, LLP

(57) ABSTRACT

A hydrogenation-dehydrogenation method for a TiAl alloy includes performing hydrogenation treatment of the TiAl alloy in an environment of a set temperature equal to or higher than a temperature at which phase transformation to a β phase starts; and performing dehydrogenation treatment of the TiAl alloy which has been subjected to the hydrogenation treatment. The set temperature ranges from 1,100° C. to 1,600° C.

6 Claims, 5 Drawing Sheets

(51) Int. Cl.
*C22C 14/00* (2006.01)
*C22F 1/18* (2006.01)

(58) Field of Classification Search
CPC ..... C22C 14/00; C22C 1/0491; C22F 1/183; C22F 1/18
USPC ..... 148/513
See application file for complete search history.

(56) References Cited

U.S. PATENT DOCUMENTS

2016/0230239 A1 8/2016 Kennedy et al.
2016/0243617 A1 8/2016 Ivasishin et al.
2016/0354976 A1* 12/2016 Zhang ..... B22F 3/1007

FOREIGN PATENT DOCUMENTS

JP 05339606 A 12/1993
JP 2009221603 A 10/2009
JP 2013053333 A 3/2013

OTHER PUBLICATIONS

Froes et al. Thermochemical processing of titanium alloys, The Journal of the Minerals, Metals, & Materials Society, Mar. 1990 (Year: 1990).*

Extended European Search Report of European Application No. 17879128.1 dated Mar. 18, 2020; 33pp.

International Search Report and Written Opinion for International Application No. PCT/JP2017/043858 dated Mar. 6, 2018; 7pp.

Office Action for Canadian Application No. 3,029,174 dated Feb. 6, 2020; 5pp.

C.R.F. Azevedo et al. "Ti—Al—V powder metallurgy (PM) via the hydrogenation-dehydrogenation (HDH) process", Journal of Alloys and Compounds 353, Apr. 7, 2003, pp. 217-227; 11pp.

* cited by examiner

| | COMPRESSION BREAKING STRENGTH (MPa) |
|---|---|
| EXAMPLE (HYDROGENATION TREATMENT AT 1,400°C) | 890 |
| | 967 |
| COMPARATIVE EXAMPLE 1 (NO HYDROGENATION TREATMENT) | 1710 |
| | 1672 |
| COMPARATIVE EXAMPLE 2 (HYDROGENATION TREATMENT AT 700°C) | 1488 |
| | 1506 |

HYDROGENATION-DEHYDROGENATION METHOD FOR TIAL ALLOY AND METHOD FOR PRODUCING TIAL ALLOY POWDER

RELATED APPLICATIONS

The present application is a National Phase of International Application Number PCT/JP2017/043858, filed on Dec. 6, 2017, and claims priority of Japanese Application Number 2016-237870, filed on Dec. 7, 2016

TECHNICAL FIELD

The present invention relates to a hydrogenation dehydrogenation method for a TiAl alloy and a method for producing a TiAl alloy powder.

BACKGROUND ART

A TiAl alloy is an alloy consisting of titanium (Ti) and aluminum (Al) which are bonded to each other (intermetallic compound). Due to its lightness in weight and high strength at a high temperature, a TiAl alloy is applied to high-temperature structure materials such as engines and aerospace instruments. For the reason of low ductility or the like, a TiAl alloy is sometimes molded by sintering, instead of forging, casting, or the like. In this case, a powder of a TiAl alloy is molded into a required shape, and a compact thereof is sintered to produce a product of a TiAl alloy.

Generally, a powder of a TiAl alloy is produced by pulverizing a TiAl alloy (an ingot of a TiAl alloy) by a gas atomizing method. In addition, as disclosed in PTL 1, for titanium, there are cases where a powder is produced by using a hydrogenation-dehydrogenation (HDH: hydride-dehydride) method. In the hydrogenation-dehydrogenation method using titanium, titanium is subjected to hydrogenation treatment to form brittle hydride (hydrogenated titanium). Accordingly, strength of titanium is decreased and crushability is improved. Then, a titanium powder is produced by crushing this titanium decreased in strength.

CITATION LIST

Patent Literature

[PTL 1] Japanese Unexamined Patent Application Publication No. 3-122205

SUMMARY OF INVENTION

Technical Problem

However, in a gas atomizing method, it is difficult to stably obtain a powder having a small particle size, and it tends to be high cost. On the other hand, in the hydrogenation-dehydrogenation method, in addition to being low cost, a powder having a small particle size can be stably obtained. However, since a TiAl alloy forms an intermetallic compound, hydride is unlikely to be formed. Therefore, even if hydrogenation-dehydrogenation treatment is performed on the same condition as that of titanium, it is difficult to decrease the strength of a TiAl alloy, and a powder of a TiAl alloy cannot be adequately produced.

The present invention is to solve the problem described above, and an object thereof is to provide a hydrogenation-dehydrogenation method for a TiAl alloy and a method for producing a TiAl alloy powder, in which a powder of a TiAl alloy is adequately produced.

Solution to Problem

In order to solve the problem described above and to achieve the object, according to the present disclosure, there is provided a hydrogenation-dehydrogenation method for a TiAl alloy including a hydrogenation treatment step of performing hydrogenation treatment of the TiAl alloy in an environment of a set temperature equal to or higher than a temperature at which phase transformation to a β phase starts, and a dehydrogenation treatment step of performing dehydrogenation treatment of the TiAl alloy which has been subjected to the hydrogenation treatment. In this hydrogenation-dehydrogenation method for a TiAl alloy, the set temperature is equal to or higher than a temperature at which phase transformation to the β phase starts, so that the β phase is generated inside the TiAl alloy and the solid solution amount of hydrogen inside the TiAl alloy is increased. In this hydrogenation-dehydrogenation method, hydrogen is caused to be in a solid solution state in the TiAl alloy in this manner, so that strength of the TiAl alloy is adequately decreased, and a powder of a TiAl alloy can be adequately produced.

In the hydrogenation-dehydrogenation method for a TiAl alloy, it is preferable that the set temperature is equal to or higher than a temperature at which the TiAl alloy is completely phase-transformed to the β phase. Accordingly, in this hydrogenation-dehydrogenation method, the solid solution amount of hydrogen inside the TiAl alloy is further increased, so that strength of the TiAl alloy can be more adequately decreased. Therefore, a powder of a TiAl alloy can be more adequately produced by using this hydrogenation-dehydrogenation method.

In the hydrogenation-dehydrogenation method for a TiAl alloy, it is preferable that the set temperature is a temperature lower than a melting point of the TiAl alloy. In this hydrogenation-dehydrogenation method, the TiAl alloy is at a temperature lower than the melting point, so that a high temperature state with only an L phase in a hydrogen atmosphere is prevented, and hydrogenation treatment can be more safely performed.

In the hydrogenation-dehydrogenation method for a TiAl alloy, it is preferable that the set temperature ranges from 1,100° C. to lower than 1,600° C. In this hydrogenation-dehydrogenation method, the set temperature is within this temperature range, so that the β phase is adequately generated inside the TiAl alloy, and the TiAl alloy is in a state of being not melted. Therefore, in this hydrogenation-dehydrogenation method, a powder of a TiAl alloy can be more adequately produced.

In the hydrogenation-dehydrogenation method for a TiAl alloy, it is preferable that in the hydrogenation treatment step, the hydrogenation treatment is performed in an environment in which a partial pressure of hydrogen becomes equal to or higher than an atmospheric pressure. Accordingly, in this hydrogenation-dehydrogenation method, the solid solution amount of hydrogen inside the TiAl alloy is increased, and strength of the TiAl alloy can be more adequately decreased. Therefore, a powder of a TiAl alloy can be more adequately produced by using this hydrogenation-dehydrogenation method.

In order to solve the problem described above and to achieve the object, according to the present disclosure, there is provided a method for producing a TiAl alloy powder including crushing a TiAl alloy which has been subjected to the dehydrogenation treatment by the hydrogenation-dehydrogenation method for a TiAl alloy. In this method for producing a TiAl alloy powder, strength of the TiAl alloy is decreased by the hydrogenation-dehydrogenation method. Thus, a powder of a TiAl alloy can be more adequately produced.

In order to solve the problem described above and to achieve the object, according to the present disclosure, there is provided a method for producing a TiAl alloy powder including crushing a TiAl alloy which has been subjected to the hydrogenation treatment by the hydrogenation-dehydrogenation method for a TiAl alloy, and performing dehydrogenation treatment of the crushed TiAl alloy. In this method for producing a TiAl alloy powder, strength of the TiAl alloy is decreased by the hydrogenation treatment. Thus, a powder of a TiAl alloy can be more adequately produced.

Advantageous Effects of Invention

According to the present invention, a powder of a TiAl alloy can be adequately produced.

DESCRIPTION OF EMBODIMENTS

Hereinafter, with reference to the accompanying drawings, a preferable embodiment of the present invention will be described in detail. The present invention is not limited to this embodiment. In addition, in a case where there are a plurality of embodiments, the present invention also includes a configuration in which the embodiments are combined.

Embodiment

Figure 1:
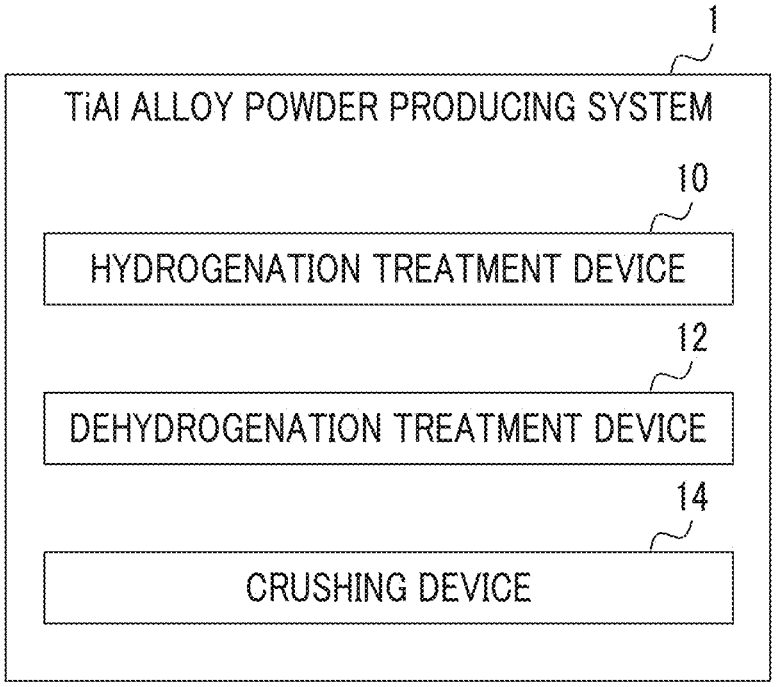
FIG. 1 is a schematic block diagram of a TiAl alloy powder producing system according to the present embodiment.

FIG. 1 is a schematic block diagram of a TiAl alloy powder producing system according to the present embodiment. A TiAl alloy powder producing system 1 according to the present embodiment is a system producing a TiAl alloy powder by using a TiAl alloy. As illustrated in FIG. 1, the TiAl alloy powder producing system 1 has a hydrogenation treatment device 10, a dehydrogenation treatment device 12, and a crushing device 14.

The hydrogenation treatment device 10 is a device performing hydrogenation treatment of a TiAl alloy A1. The TiAl alloy A1 is a lump (ingot) of a TiAl alloy. The TiAl alloy A1 is an alloy having a TiAl alloy (TiAl-based intermetallic compound) as a main component. In the present embodiment, a TiAl alloy is an alloy in which titanium (Ti) and aluminum (Al) are bonded to each other (TiAl, $Ti_3Al$, $Al_3Ti$, or the like). Moreover, a mixture may be in a solid solution state. Here, a mixture is a substance such as a metal other than Ti and Al. For example, a mixture contains at least one of niobium (Nb), chromium (Cr), vanadium (V), manganese (Mn), molybdenum (Mo), tungsten (W), tantalum (Ta), silicon (Si), and carbon (C). In the present embodiment, the TiAl alloy A1 contains Ti within a range of 19.8 weight % to 79.992 weight %, Al within a range of 19.8 weight % to 79.992 weight %, and a mixture within a range of 0 weight % to 29.997 weight %. However, it is preferable that the TiAl alloy A1 includes Al within a range of 30 weight % to 55 weight %. A β phase (which will be described below) can be adequately generated by including Al within this range. However, the component ratio of the TiAl alloy A1 is not limited thereto and is set in any desired manner. In addition, the TiAl alloy A1 may include unavoidable impurities.

Figure 2:
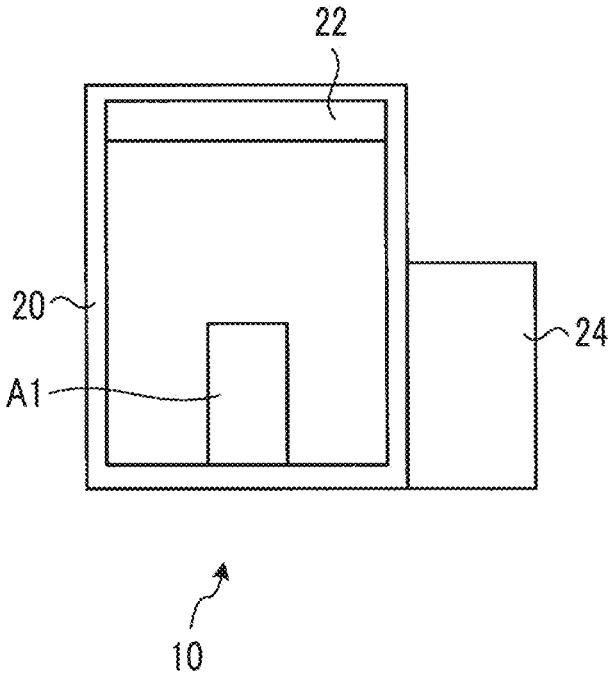
FIG. 2 is a schematic view of a hydrogenation treatment device according to the present embodiment.

FIG. 2 is a schematic view of a hydrogenation treatment device according to the present embodiment. As illustrated in FIG. 2, the hydrogenation treatment device 10 has a hydrogenation treatment chamber 20, a heating unit 22, and a hydrogen supply unit 24. The hydrogenation treatment chamber 20 is a container or a room for performing hydrogenation treatment of the TiAl alloy A1 and can be isolated from the outside. The heating unit 22 is a device heating the inside of the hydrogenation treatment chamber 20 to a predetermined temperature. The hydrogen supply unit 24 is a device discharging gas (air or the like) inside the hydrogenation treatment chamber 20 and supplying hydrogen to the inside of the hydrogenation treatment chamber 20.

In a case of performing hydrogenation treatment by using the hydrogenation treatment device 10, the TiAl alloy A1 is accommodated inside the hydrogenation treatment chamber 20. Then, air is discharged from the inside of the hydrogenation treatment chamber 20 by the hydrogen supply unit 24, so that hydrogen is supplied to the inside of the hydrogenation treatment chamber 20. Accordingly, the hydrogen supply unit 24 causes the inside of the hydrogenation treatment chamber 20 to be in a hydrogen atmosphere. The hydrogen supply unit 24 supplies hydrogen such that the partial pressure of hydrogen inside the hydrogenation treatment chamber 20 becomes the same as the atmospheric pressure. It is preferable that the hydrogen supply unit 24 supplies hydrogen such that the partial pressure of hydrogen inside the hydrogenation treatment chamber 20 becomes equal to or higher than the atmospheric pressure and may supply hydrogen such that the partial pressure of hydrogen becomes higher than the atmospheric pressure. For example, it is preferable that the hydrogen supply unit 24 causes the partial pressure of hydrogen to be within a range of 1 bar to 10 bars. However, the partial pressure of hydrogen inside the hydrogenation treatment chamber 20 is set in any desired manner.

The heating unit 22 heats the inside of the hydrogenation treatment chamber 20 to a predetermined set temperature and maintains the temperature at the set temperature for a predetermined set time. Accordingly, the hydrogenation treatment device 10 performs hydrogenation treatment of the TiAl alloy A1 in an environment of the set temperature and generates a hydrogen solid solution TiAl alloy A2 in which hydrogen is included in the TiAl alloy A1 in a solid solution state. This set temperature is a temperature equal to or higher than a β phase transformation starting temperature T1 and is a temperature lower than a melting point temperature T2. The β phase transformation starting temperature T1 is a temperature at which phase transformation to the β phase (phase change to the β phase) starts in the TiAl alloy A1. The melting point temperature T2 is a melting point of the TiAl alloy A1 and is a temperature higher than the β phase transformation starting temperature T1. In addition, it is preferable that the set temperature is equal to or higher than a β phase transformation completion temperature T3. The β phase transformation completion temperature T3 is a temperature at which the TiAl alloy A1 is completely phase-transformed to the β phase. The β phase transformation completion temperature T3 is higher than the β phase transformation starting temperature T1 and is lower than the melting point temperature T2. However, the set temperature need only be a temperature equal to or higher than the β phase transformation starting temperature T1 and does not have to be a temperature lower than the melting point temperature T2.

Figure 3A:
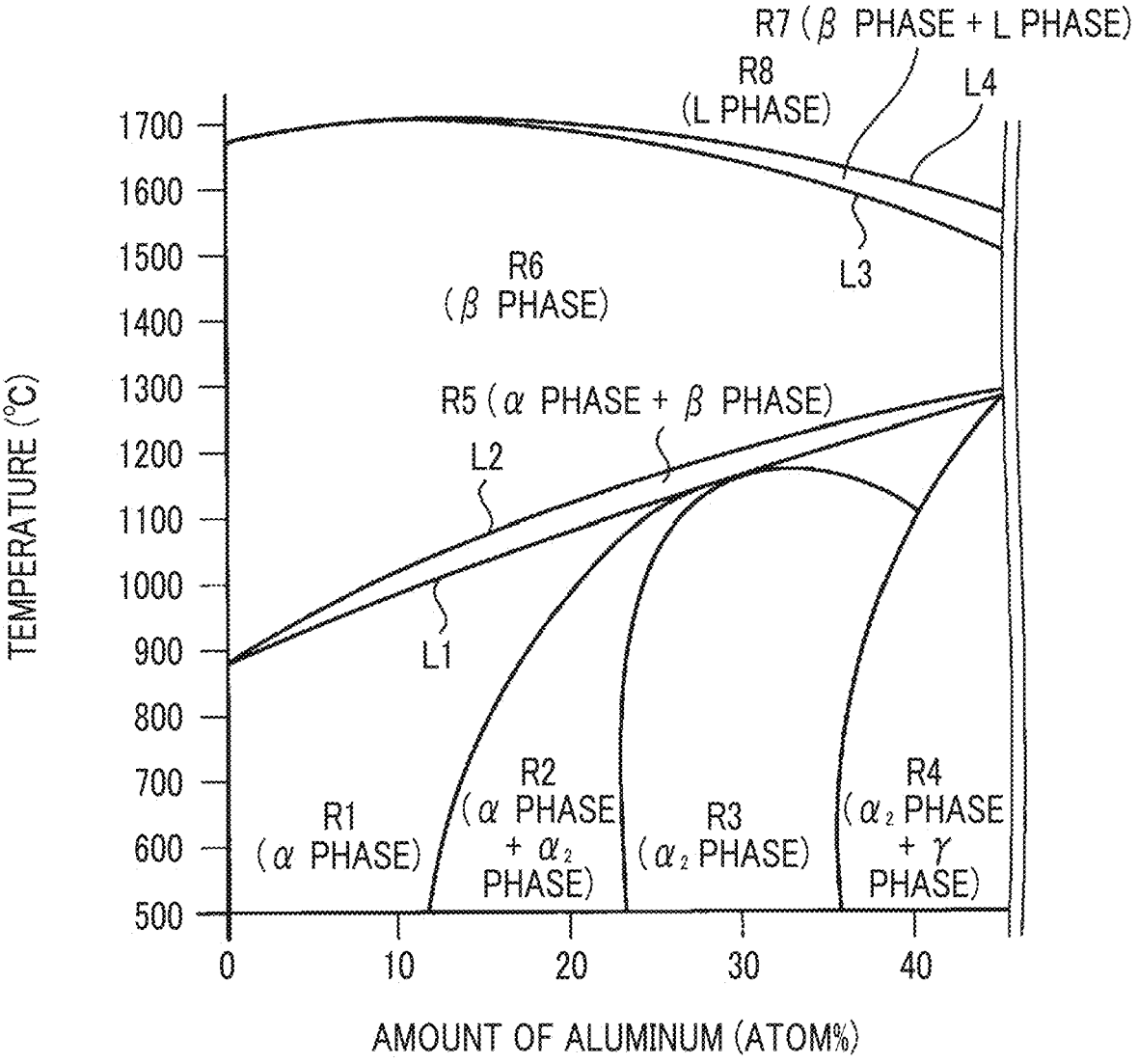
FIG. 3A is a schematic view illustrating an example of a state diagram of a TiAl alloy.

Hereinafter, the β phase transformation starting temperature T1, the β phase transformation completion temperature T3, and the melting point temperature T2 will be described by using state diagrams. FIG. 3A is a schematic view illustrating an example of a state diagram of a TiAl alloy. FIG. 3A is an example of a state diagram of the TiAl alloy. The horizontal axis indicates the concentration, that is, the content (atom %) of Al, and the vertical axis indicates the temperature of the TiAl alloy A1.

As illustrated in FIG. 3A, the metal phase of the TiAl alloy A1 changes due to the Al content and the temperature of the TiAl alloy A1. A region R1 in FIG. 3A is a region in which the TiAl alloy A1 constitutes an α phase (closest-packed cubic crystal of a Ti simple-substance). A region R2 is a region corresponding to a position at which the Al content is increased with respect to the region R1. In the region R2, the TiAl alloy A1 constitutes the α phase and an $\alpha_2$ phase (closest-packed cubic crystal of $Ti_3Al$). A region R3 is a region corresponding to a position at which the Al content is increased with respect to the region R2. In the region R3, the TiAl alloy A1 constitutes the $\alpha_2$ phase. A region R4 is a region corresponding to a position at which the Al content is increased with respect to the region R3. In the region R4, the TiAl alloy A1 constitutes the $\alpha_2$ phase and a γ phase (face-centered cubic crystal of TiAl).

A region R5 is a region corresponding to a position at which the temperature of the TiAl alloy A1 is increased with respect to the region R4 from the region R1. In the region R5, the TiAl alloy A1 constitutes the α phase and the β phase (body-centered cubic crystal of Ti). A region R6 is a region corresponding to a position at which the temperature of the TiAl alloy A1 is increased with respect to the region R5. In the region R6, the TiAl alloy A1 constitutes the β phase. A region R7 is a region corresponding to a position at which the temperature of the TiAl alloy A1 is increased with respect to the region R6. In the region R7, the TiAl alloy A1 constitutes the β phase and an L phase (liquid phase). A region R8 is a region corresponding to a position at which the temperature of the TiAl alloy A1 is increased with respect to the region R7. In the region R8, the TiAl alloy A1 constitutes the L phase. In all of the regions, a mixture is in a solid solution state in each of the phases.

Here, the border line of the region R5 on a low temperature side, that is, the border line between the region R4 from the region R1 and the region R5 is a line L1. The line L1 can indicate a border at which phase transformation to the β phase starts when the temperature exceeds the line L1. That is, the line L1 indicates the β phase transformation starting temperature T1 for each Al concentration. In addition, the border line of the region R5 on a high temperature side, that is, the border line between the region R5 and the region R6 is a line L2. The line L2 can indicate a border at which the α phase disappears from the TiAl alloy A1 and the TiAl alloy Ai is completely phase-transformed to the β phase (there is only the β phase) when the temperature exceeds the line L2. That is, the line L2 indicates the β phase transformation completion temperature T3 for each Al concentration.

In addition, the border line of the region R6 on a high temperature side, that is, the border line between the region R6 and the region R7 is a line L3. The line L3 can indicate a border at which phase transformation to the L phase starts when the temperature exceeds the line L3. That is, the line L3 indicates a temperature at which phase transformation to the L phase for each Al concentration starts. The hydrogenation treatment device 10 may have the set temperature as a temperature at which this phase transformation to the L phase starts, that is, a temperature equal to or higher than a temperature at which the β phase and the L phase start to coexist. Moreover, the set temperature may be a temperature equal to or higher than this temperature and lower than the melting point temperature T2. In addition, the border line of the region R7 on a high temperature side, that is, the border line between the region R7 and the region R8 is a line L4. The line L4 can indicate a border at which the β phase disappears from the TiAl alloy A1 and the TiAl alloy A1 is completely phase-transformed to the L phase (there is only the L phase) when the temperature exceeds the line L4. That is, the line L4 indicates the melting point temperature T2 for each Al concentration.

Figure 3B:
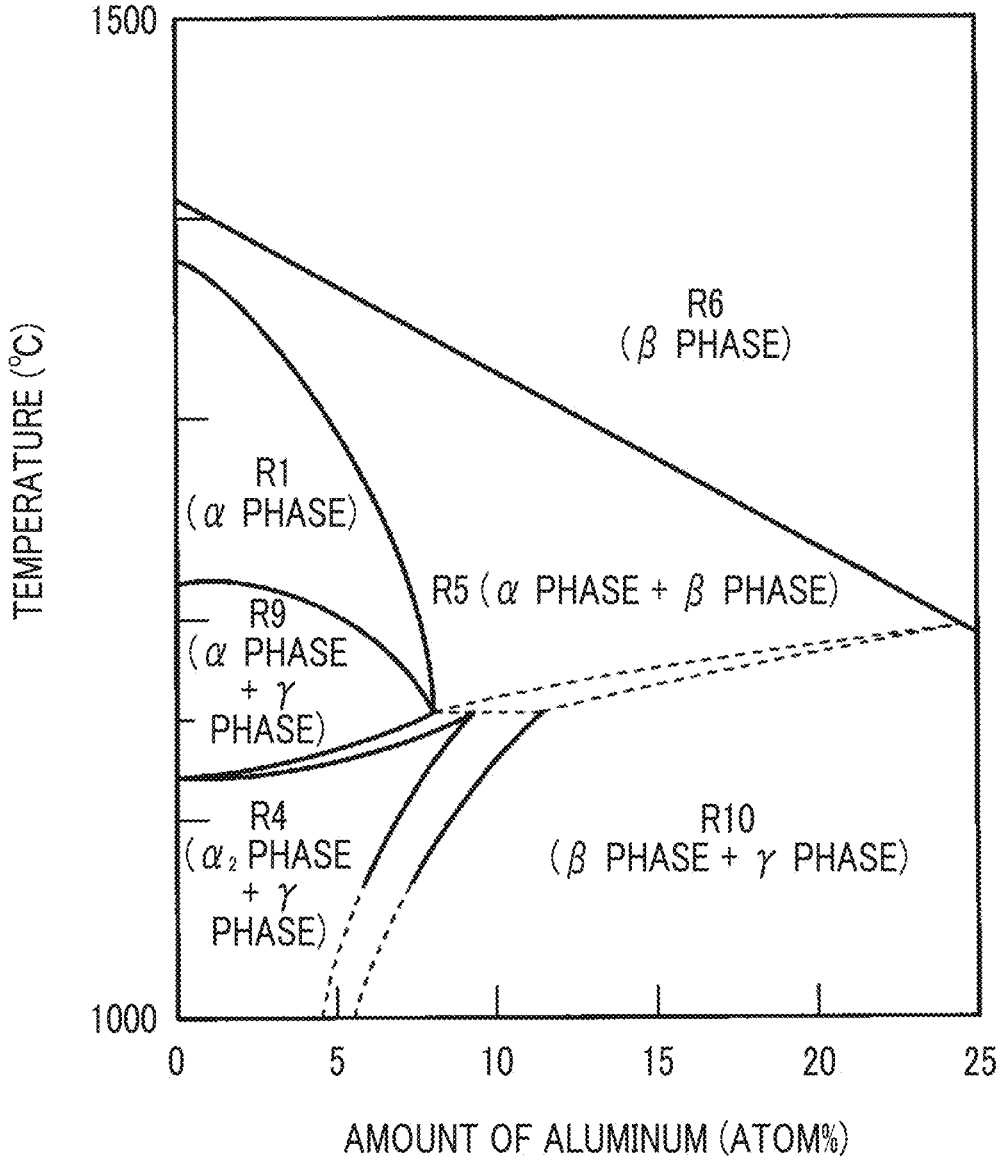
FIG. 3B is a schematic view illustrating an example of another state diagram of the TiAl alloy.

As indicated with the lines L1, L2, and L4, the β phase transformation starting temperature T1, the β phase transformation completion temperature T3, and the melting point temperature T2 changes due to the Al content. In addition, FIG. 3A illustrates an example of a state diagram of a TiAl alloy, and the state diagram of a TiAl alloy changes in accordance with the kind or the content ratio of a mixture. FIG. 3B is a schematic view illustrating an example of another state diagram of the TiAl alloy. FIG. 3B is an example of a state diagram of a TiAl alloy including vanadium (V) as a mixture. In FIG. 3B, the horizontal axis indicates the concentration (atom %) of V, and the vertical axis indicates the temperature of the TiAl alloy A1. The TiAl alloy A1 in FIG. 3B includes 42% (atom %) of Al. As illustrated in FIG. 3B, the TiAl alloy A1 including V has a region R9 including the α phase and the γ phase, and a region R10 including the β phase and the γ phase. As illustrated in FIGS. 3A and 3B, in the TiAl alloy, the temperature and the Al content (corresponding to the shape from the line L1 to the line L4), at which phase transformation occurs, change in accordance with the kind or the content ratio of a mixture. That is, the β phase transformation starting temperature T1, the β phase transformation completion temperature T3, and the melting point temperature T2 also change in accordance with the kind or the content ratio of a mixture, in addition to the Al concentration. However, even in a case of any component ratio of the TiAl alloy A1, the β phase transformation starting temperature T1 is a temperature at which phase transformation of the TiAl alloy A1 to the β phase starts, the β phase transformation completion temperature T3 is a temperature at which phase transformation of the TiAl alloy A1 to the β phase ends (completely phase-transformed to the β phase), and the melting point temperature T2 is the melting point of the TiAl alloy A1.

Since the TiAl alloy A1 forms an intermetallic compound, the TiAl alloy A1 is unlikely to chemically react to hydrogen and it is difficult to form hydride. On the other hand, when the temperature becomes equal to or higher than the β phase transformation starting temperature T1, the TiAl alloy A1 starts to form the β phase. Since the β phase has a wide atomic interspace and has many hydrogen trapping sites, hydrogen is likely to be in a solid solution state. Therefore, when the TiAl alloy A1 is phase-transformed to the β phase, the solid solution amount of hydrogen can be increased. Consequently, the hydrogenation treatment device 10 performs hydrogenation treatment of the TiAl alloy A1 at the set temperature, that is, in an environment of a temperature equal to or higher than the β phase transformation starting temperature T1. The hydrogenation treatment device 10 generates the β phase in the TiAl alloy A1 when being at a temperature equal to or higher than the β phase transformation starting temperature T1. Then, the hydrogenation treatment device 10 causes hydrogen to be in a solid solution state in the β phase of the TiAl alloy A1 in a hydrogen atmosphere, that is, the hydrogen solid solution TiAl alloy A2 is generated by taking hydrogen into the TiAl alloy A1. When hydrogen is in a solid solution state, strength of the hydrogen solid solution TiAl alloy A2 becomes lower than that of the TiAl alloy A1. In the hydrogen solid solution TiAl alloy A2, components other than hydrogen are the same as the TiAl alloy A1.

Thereafter, the hydrogen solid solution TiAl alloy A2 is subjected to natural cooling or forced cooling to a normal temperature. When the hydrogen solid solution TiAl alloy A2 is cooled, the β phase is phase-transformed to the α phase or the like. However, it causes embrittlement (a decrease in strength) due to a release and rearrangement of hydrogen in a solid solution state accompanying the phase transformation.

It is preferable that the set temperature ranges from 1,100° C. to 1,600° C. Within this temperature range, the β phase is adequately generated inside the TiAl alloy A1, and the TiAl alloy A1 does not melt. In addition, it is more preferable that the set temperature ranges from 1,300° C. to 1,600° C. Within this temperature range, the TiAl alloy A1 is completely phase-transformed to the β phase, and the TiAl alloy A1 does not melt. In addition, the set time for performing hydrogenation treatment, that is, a time for holding the TiAl alloy A1 in a hydrogen atmosphere at the set temperature is set in any desired manner. However, it is preferable that the set time is within a range of 0.1 hours to 24 hours.

Next, the dehydrogenation treatment device 12 illustrated in FIG. 1 will be described. The dehydrogenation treatment device 12 performs dehydrogenation treatment of the hydrogen solid solution TiAl alloy A2 and generates a dehydrogenated TiAl alloy A3. The dehydrogenated TiAl alloy A3 is an alloy obtained by eliminating hydrogen from the hydrogen solid solution TiAl alloy A2 and has the same components as those of the TiAl alloy A1. However, since the dehydrogenated TiAl alloy A3 has passed through hydrogenation treatment, strength thereof remains lower than that of the TiAl alloy A1.

Figure 4:
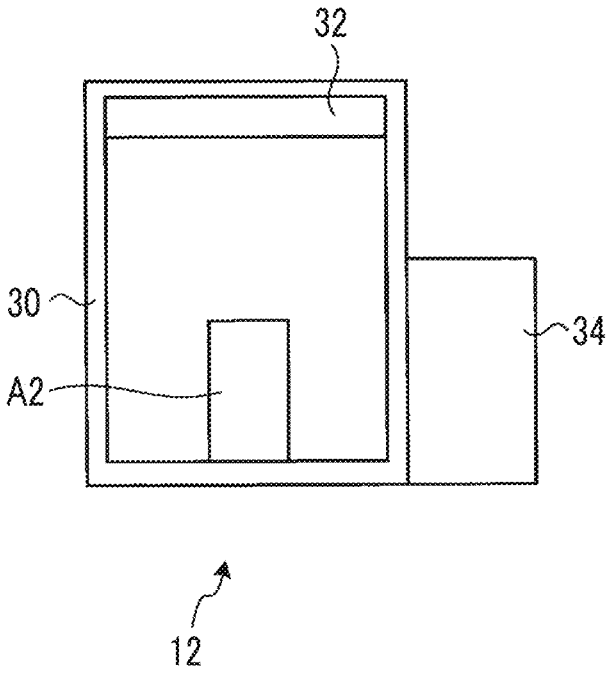
FIG. 4 is a schematic view of a dehydrogenation treatment device according to the present embodiment.

FIG. 4 is a schematic view of a dehydrogenation treatment device according to the present embodiment. As illustrated in FIG. 4, the dehydrogenation treatment device 12 has a dehydrogenation treatment chamber 30, a heating unit 32, and an exhaust unit 34. The dehydrogenation treatment chamber 30 is a container or a room for performing dehydrogenation treatment of the hydrogen solid solution TiAl alloy A2 and can be isolated from the outside. The heating unit 32 is a device heating the dehydrogenation treatment chamber 30 to a predetermined temperature. The exhaust unit 34 is a device discharging gas (air or the like) inside the dehydrogenation treatment chamber 30 and realizing a vacuum state.

The dehydrogenation treatment device 12 causes the dehydrogenation treatment chamber 30 accommodating the hydrogen solid solution TiAl alloy A2 to be in a vacuum state in an environment of a temperature within a range of 400° C. to 700° C., for example and holds the state for 0.1 hours to 24 hours. Accordingly, the dehydrogenation treatment device 12 performs dehydrogenation treatment of the hydrogen solid solution TiAl alloy A2 and releases hydrogen in a solid solution state inside the hydrogen solid solution TiAl alloy A2. Accordingly, the dehydrogenated TiAl alloy A3 is generated.

In this manner, the hydrogenation treatment device 10 performs hydrogenation treatment of the TiAl alloy A1 and generates the hydrogen solid solution TiAl alloy A2, and the dehydrogenation treatment device 12 performs dehydrogenation treatment of the hydrogen solid solution TiAl alloy A2 and generates the dehydrogenated TiAl alloy A3. That is, the hydrogenation treatment device 10 and the dehydrogenation treatment device 12 perform hydrogenation-dehydrogenation treatment of the TiAl alloy A1.

The crushing device 14 illustrated in FIG. 1 is a mill, for example. However, any crushing device may be adopted as long as it can crush the hydrogen solid solution TiAl alloy A2 or the dehydrogenated TiAl alloy A3. The crushing device 14 produces a TiAl alloy powder A4 by crushing the dehydrogenated TiAl alloy A3 in a solid state. The dehydrogenated TiAl alloy A3 has decreased in strength through hydrogenation treatment. Therefore, the crushing device 14 can easily crush the dehydrogenated TiAl alloy A3, so that a powder having a small particle size can be easily obtained. The crushing device 14 may produce a TiAl alloy powder A4' by crushing the hydrogen solid solution TiAl alloy A2 in a solid state before being subjected to dehydrogenation treatment. The hydrogen solid solution TiAl alloy A2 is a TiAl alloy which has been subjected to hydrogenation treatment but has not been subjected to dehydrogenation treatment. The TiAl alloy powder A4' is a powder of a TiAl alloy which has not been subjected to dehydrogenation treatment. Since the hydrogen solid solution TiAl alloy A2 has also decreased in strength through hydrogenation treatment, the crushing device 14 can easily crush the hydrogen solid solution TiAl alloy A2. In this case, the TiAl alloy powder producing system 1 produces the TiAl alloy powder A4 by performing dehydrogenation treatment of the TiAl alloy powder A4' using the dehydrogenation treatment device 12. The TiAl alloy powder A4 has the same components as those of the TiAl alloy A1. In addition, since the TiAl alloy powder A4 is produced by crushing, each of the particles has an uneven shape.

Figures 5, 6:
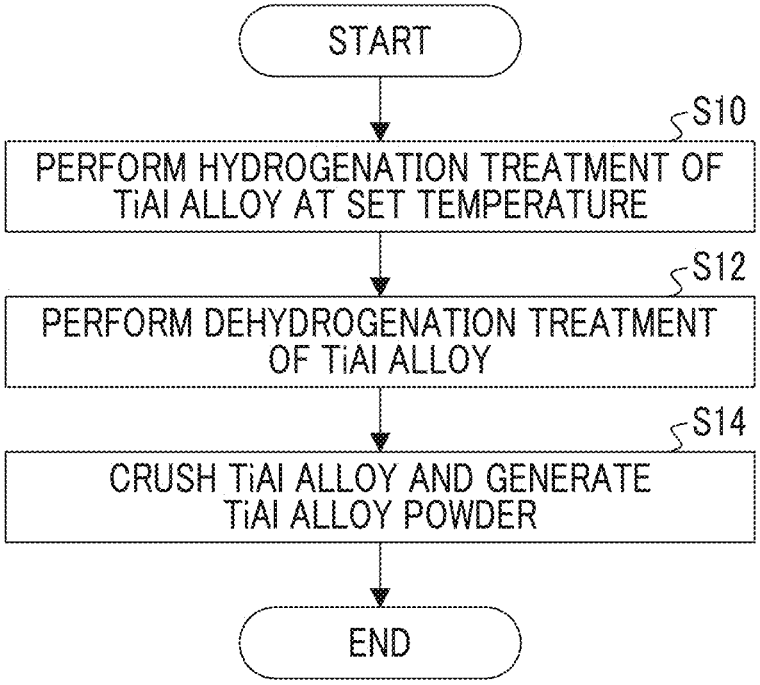
FIG. 5 is a flowchart describing a method for producing a TiAl alloy powder.
FIG. 6 is a table showing results of compression breaking strength in Example and Comparative Examples.

Next, a method for producing the TiAl alloy powder A4 will be described based on a flowchart. FIG. 5 is a flowchart describing a method for producing a TiAl alloy powder. As illustrated in FIG. 5, the TiAl alloy powder producing system 1 performs hydrogenation treatment of the TiAl alloy A1 using the hydrogenation treatment device 10 at the set temperature (Step S10; a hydrogenation treatment step) and generates the hydrogen solid solution TiAl alloy A2. The set temperature is equal to or higher than the β phase transformation starting temperature T1. Therefore, the hydrogenation treatment device 10 can increase the solid solution amount of hydrogen with respect to the TiAl alloy A1 and can adequately generate the hydrogen solid solution TiAl alloy A2 in which hydrogen is in a solid solution state.

After hydrogenation treatment is performed, the TiAl alloy powder producing system 1 performs dehydrogenation treatment of the TiAl alloy which has been subjected to hydrogenation treatment, that is, the hydrogen solid solution TiAl alloy A2 using the dehydrogenation treatment device 12 (Step S12; a dehydrogenation treatment step) and generates the dehydrogenated TiAl alloy A3. Specifically, while the cooled hydrogen solid solution TiAl alloy A2 is in a vacuum environment at a predetermined temperature, the dehydrogenation treatment device 12 releases hydrogen in a solid solution state inside the hydrogen solid solution TiAl alloy A2 and generates the dehydrogenated TiAl alloy A3.

After dehydrogenation treatment is performed, the TiAl alloy powder producing system 1 crushes the TiAl alloy after being subjected to dehydrogenation treatment by the crushing device 14, that is, the dehydrogenated TiAl alloy A3 and generates the TiAl alloy powder A4 (Step S14). The flow of producing the TiAl alloy powder A4 hereby ends.

The TiAl alloy powder producing system 1 may crush the TiAl alloy after being subjected to hydrogenation treatment before dehydrogenation treatment and may perform dehydrogenation treatment of the crushed TiAl alloy. In this case, the TiAl alloy powder producing system 1 generates the hydrogen solid solution TiAl alloy A2 in Step S10. Thereafter, the TiAl alloy powder producing system 1 crushes the hydrogen solid solution TiAl alloy A2 using the crushing device 14 and generates the TiAl alloy powder A4'. Thereafter, the TiAl alloy powder producing system 1 performs dehydrogenation treatment of the TiAl alloy powder A4' using the dehydrogenation treatment device 12 and generates the TiAl alloy powder A4. The TiAl alloy decreases in strength through hydrogenation treatment. Therefore, as described above, crushing treatment may be performed after hydrogenation treatment is performed and may be performed before or after dehydrogenation treatment.

As described above, a hydrogenation-dehydrogenation method for a TiAl alloy according to the present embodiment has the hydrogenation treatment step and the dehydrogenation treatment step. In the hydrogenation treatment step, the TiAl alloy A1 is subjected to hydrogenation treatment in an environment of the set temperature. The set temperature is equal to or higher than a temperature (the β phase transformation starting temperature T1) at which phase transformation of the TiAl alloy A1 to the β phase starts. In the dehydrogenation treatment step, the TiAl alloy A1 (the hydrogen solid solution TiAl alloy A2) which has been subjected to hydrogenation treatment is subjected to dehydrogenation treatment.

In this hydrogenation-dehydrogenation method, the β phase is generated inside the TiAl alloy A1 by heating the TiAl alloy A1 to a temperature equal to or higher than the β phase transformation starting temperature T1 and the solid solution amount of hydrogen into the TiAl alloy A1 is increased. In this hydrogenation-dehydrogenation method, hydrogen is caused to be in a solid solution state in the TiAl alloy A1, so that strength of the TiAl alloy A1 is adequately decreased. Then, in this hydrogenation-dehydrogenation method, while a low strength state is maintained, hydrogen in a solid solution state in the TiAl alloy A1 can be eliminated by carrying out the dehydrogenation treatment step. Strength of the TiAl alloy A1 can be adequately decreased by using this hydrogenation-dehydrogenation method. Therefore, the TiAl alloy powder A4 having a small particle size can be easily produced. In addition, hydrogenation treatment and dehydrogenation treatment can be carried out at low cost compared to a gas atomizing method, for example. Therefore, a powder of a TiAl alloy can be adequately produced by using this hydrogenation-dehydrogenation method.

In addition, it is preferable that the set temperature is equal to or higher than a temperature (the β phase transformation completion temperature T3) at which the TiAl alloy A1 is completely phase-transformed to the β phase. In this hydrogenation-dehydrogenation method, all of the phases in the TiAl alloy A1 can become the β phase by heating the TiAl alloy A1 to a temperature equal to or higher than the β phase transformation completion temperature T3. Accordingly, in the hydrogenation-dehydrogenation method, the solid solution amount of hydrogen inside the TiAl alloy A1 is increased, so that strength of the TiAl alloy A1 can be more adequately decreased. Therefore, a powder of a TiAl alloy can be more adequately produced by using this hydrogenation-dehydrogenation method.

In addition, it is preferable that the set temperature is a temperature lower than the melting point of the TiAl alloy A1 (the melting point temperature T2). In this hydrogenation-dehydrogenation method, the TiAl alloy A1 is at a temperature equal to or higher than the β phase transformation starting temperature T1 and lower than the melting point temperature T2, so that a high temperature state with only the L phase in a hydrogen atmosphere is prevented, and hydrogenation treatment can be more safely performed.

In addition, it is preferable that the set temperature ranges from 1,100° C. to 1,600° C. In this hydrogenation-dehydrogenation method, the set temperature is within this temperature range, so that the β phase is adequately generated inside the TiAl alloy A1, and the TiAl alloy A1 is in a state of being not melted. Therefore, in this hydrogenation-dehydrogenation method, a powder of a TiAl alloy can be more adequately produced.

In addition, it is preferable that in the hydrogenation treatment step, hydrogenation treatment is performed in an environment in which the partial pressure of hydrogen becomes equal to or higher than the atmospheric pressure. Accordingly, in the hydrogenation-dehydrogenation method, the solid solution amount of hydrogen inside the TiAl alloy A1 is increased, and strength of the TiAl alloy A1 can be more adequately decreased. Therefore, a powder of a TiAl alloy can be more adequately produced by using this hydrogenation-dehydrogenation method.

In addition, in the method for producing a TiAl alloy powder according to the present embodiment, the TiAl alloy powder A4 is produced by crushing the TiAl alloy (the dehydrogenated TiAl alloy A3) which has been subjected to dehydrogenation treatment by the hydrogenation-dehydrogenation method. In this method for producing a TiAl alloy powder, strength of the TiAl alloy A1 is decreased by the hydrogenation-dehydrogenation method. Therefore, the TiAl alloy powder A4 having a small particle size can be easily produced and can be produced at low cost. Therefore, when this producing method is used, a powder of a TiAl alloy can be more adequately produced.

In addition, in the method for producing a TiAl alloy powder according to the present embodiment, the TiAl alloy powder A4 may be produced by crushing the TiAl alloy (the hydrogen solid solution TiAl alloy A2) which has been subjected to hydrogenation treatment by the hydrogenation-dehydrogenation method, and performing dehydrogenation treatment of the crushed TiAl alloy (the TiAl alloy powder A4'). In this method for producing a TiAl alloy powder, strength of the TiAl alloy A1 is decreased by the hydrogenation-dehydrogenation method. Therefore, the TiAl alloy powder A4 having a small particle size can be easily produced and can be produced at low cost. Therefore, when this producing method is used, a powder of a TiAl alloy can be more adequately produced.

Example

Next, Example of the present embodiment will be described. In the present Example, hydrogenation treatment of a TiAl alloy containing Nb as a mixture was performed for five hours at the set temperature of 1,400° C., that is, at a temperature equal to or higher than the β phase transformation starting temperature T1. Then, dehydrogenation treatment of the TiAl alloy after being subjected to hydrogenation treatment was performed for three hours at 800° C. Thereafter, compression breaking strength of the TiAl alloy after being subjected to dehydrogenation treatment was measured. In addition, the hydrogen content of the TiAl alloy before hydrogenation treatment, after hydrogenation treatment, and after dehydrogenation treatment was measured by using an inert gas melting method.

In addition, as Comparative Example 1, compression breaking strength of a TiAl alloy having the same components was measured without performing hydrogenation treatment. Then, as Comparative Example 2, hydrogenation treatment of a TiAl alloy having the same components was performed for five hours at 700° C., that is, at a temperature lower than the β phase transformation starting temperature T1. Thereafter, dehydrogenation treatment was performed for three hours at 800° C. In Comparative Example 2, compression breaking strength of the TiAl alloy after dehydrogenation treatment was measured.

In Example, the amount of hydrogen contained in the TiAl alloy before hydrogenation treatment was 8 ppm. The amount of hydrogen contained in the TiAl alloy after hydrogenation treatment was 110 ppm. The amount of hydrogen contained in the TiAl alloy after dehydrogenation treatment was 8 ppm. That is, it is ascertained that when hydrogenation treatment is performed as in the present Example, hydrogen is sufficiently in a solid solution state inside the TiAl alloy and hydrogen is sufficiently eliminated through dehydrogenation treatment.

FIG. 6 is a table showing results of compression breaking strength in Example and Comparative Examples. As illustrated in FIG. 6, in the TiAl alloy of Example after being subjected to dehydrogenation treatment, compression breaking strength of two samples was 890 MPa and 967 MPa, respectively. On the other hand, in the TiAl alloy of Comparative Example 1 which has not been subjected to hydrogenation treatment, compression breaking strength of two samples was 1,710 MPa and 1,672 MPa, respectively. In addition, in the TiAl alloy of Comparative Example 2 after being subjected to dehydrogenation treatment, compression breaking strength of two samples was 1,488 MPa and 1,506 MPa, respectively. In this manner, it is ascertained that when hydrogenation treatment is performed at a temperature equal to or higher than the β phase transformation starting temperature T1, even in a case where dehydrogenation treatment is performed thereafter, compression breaking strength decreases. According to the present Example, since compression strength decreases in this manner, it is ascertained that crushability of the TiAl alloy powder A4 can be improved and the TiAl alloy powder A4 having a small particle size can be easily produced.

Hereinabove, the embodiment of the present invention has been described. However, the embodiment is not limited to the details of this embodiment. In addition, the constituent elements described above include elements which can be easily postulated by those skilled in the art, substantially the same elements, and elements within a so-called equivalent range. Moreover, the constituent elements described above can be suitably combined. Moreover, it is possible to make various omissions, replacements, or changes of the constituent elements within a range not departing from the gist of the embodiment described above.

REFERENCE SIGNS LIST

1 TiAl alloy powder producing system
10 hydrogenation treatment device
12 dehydrogenation treatment device
14 crushing device
20 hydrogenation treatment chamber
22, 32 heating unit
24 hydrogen supply unit
30 dehydrogenation treatment chamber
34 exhaust unit
A1 TiAl alloy
A2 hydrogen solid solution TiAl alloy
A3 dehydrogenated TiAl alloy
A4 TiAl alloy powder
T1 β phase transformation starting temperature
T2 melting point temperature
T3 β phase transformation completion temperature

The invention claimed is:

1. A method for producing a TiAl alloy powder, comprising:

performing hydrogenation treatment of an ingot of the TiAl alloy as an intermetallic compound in an environment of a set temperature equal to or higher than a temperature at which phase transformation to a β phase starts and causing strength of the TiAl alloy to decrease;

crushing the TiAl alloy which has been subjected to the hydrogenation treatment; and performing dehydrogenation treatment of the crushed TiAl alloy, wherein the set temperature ranges from 1,100° C. to 1,600° C.

2. The method for producing a TiAl alloy powder according to claim 1, wherein the set temperature is equal to or higher than a temperature at which the TiAl alloy is completely phase-transformed to the β phase.

3. The method for producing a TiAl alloy powder according to claim 1, wherein the set temperature is a temperature lower than a melting point of the TiAl alloy.

4. The method for producing a TiAl alloy powder according to claim 1, wherein the hydrogenation treatment is performed in an environment in which a partial pressure of hydrogen becomes equal to or higher than an atmospheric pressure.

5. The method for producing a TiAl alloy powder according to claim 1, wherein the set temperature ranges from 1,300° C. to 1,600° C.

6. A method for producing a TiAl alloy powder, comprising:

performing hydrogenation treatment of the TiAl alloy as an intermetallic compound in an environment of a set temperature equal to or higher than a temperature at which phase transformation to a β phase starts and causing strength of the TiAl alloy to decrease;

performing dehydrogenation treatment of the TiAl alloy which has been subjected to the hydrogenation treatment; and crushing the TiAl alloy which has been subjected to the dehydrogenation treatment, wherein the set temperature ranges from 1,100° C. to 1,600° C.

* * * * *